United States Patent [19]

Thygeson

[11] Patent Number: 4,592,287

[45] Date of Patent: Jun. 3, 1986

[54] FOLDING TABLE

[76] Inventor: Lester R. Thygeson, 550 SW. 3rd St., College Place, Wash. 99324

[21] Appl. No.: 666,812

[22] Filed: Oct. 31, 1984

[51] Int. Cl.[4] ..... A47B 3/00

[52] U.S. Cl. ..... 108/113; 108/118

[58] Field of Search ..... 108/118, 113; 297/159, 297/56

[56] References Cited

U.S. PATENT DOCUMENTS

| | | | |
|---|---|---|---|
| 719,908 | 2/1903 | Truesdell | 297/56 |
| 1,342,650 | 6/1920 | Schlegel | 297/56 |
| 1,890,710 | 12/1932 | Williams | 108/113 |
| 2,197,302 | 4/1940 | Goering | 108/118 X |
| 2,587,010 | 2/1952 | Thompson | 108/113 |
| 2,618,525 | 11/1952 | Panzer | 108/113 |
| 3,001,816 | 9/1961 | Clann | 297/56 |
| 3,692,358 | 9/1972 | Sung | 297/159 |
| 3,704,674 | 12/1972 | Johnson | 108/118 |
| 4,083,597 | 4/1978 | Dowdy | 108/113 |
| 4,229,038 | 10/1980 | Drost | 108/113 |

FOREIGN PATENT DOCUMENTS

| | | | |
|---|---|---|---|
| 6939 | 6/1892 | Fed. Rep. of Germany | 108/118 |

*Primary Examiner*—Francis K. Zugel

*Attorney, Agent, or Firm*—Delbert J. Barnard

[57] ABSTRACT

A folding table (10) of a type having crossing legs (16, 18 and 20, 22) at its two ends is provided with a longitudinal braces (24, 26). The legs (16, 18 and 20, 22) are pivotally connected together such that when the table is folded a space exists outwardly and slightly below the pivotal axes (58, 60) of the legs (16, 18 and 20, 22) in which the longitudinal brace members (24, 26) are located. The longitudinal brace member (24) is interconnected between midportions of the outside leg members (16, 20). The longitudinal brace member (26) is interconnected between midportions of the inside leg members (18, 22).

6 Claims, 9 Drawing Figures

Fig. 1
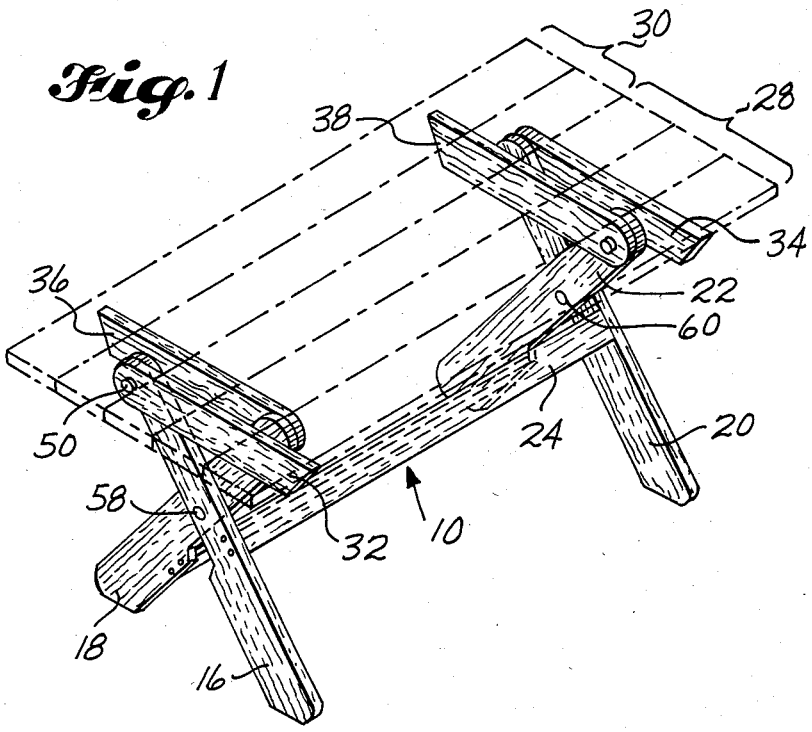
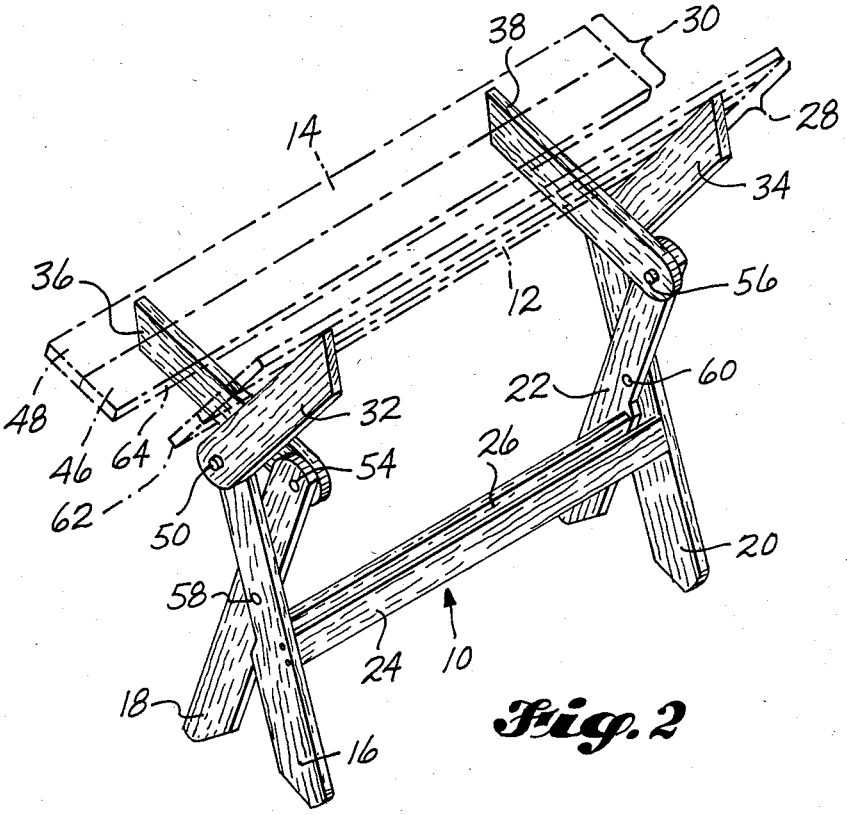
Fig. 2

Fig. 7
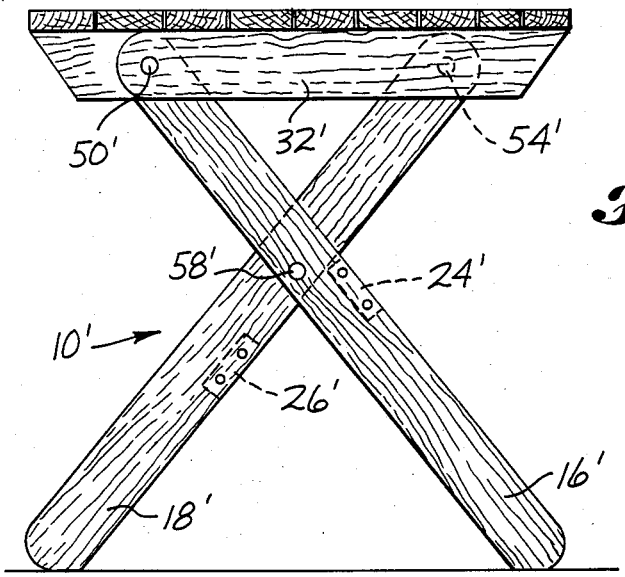
Fig. 9
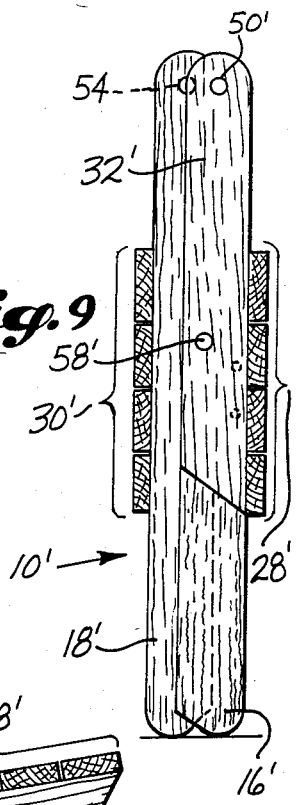
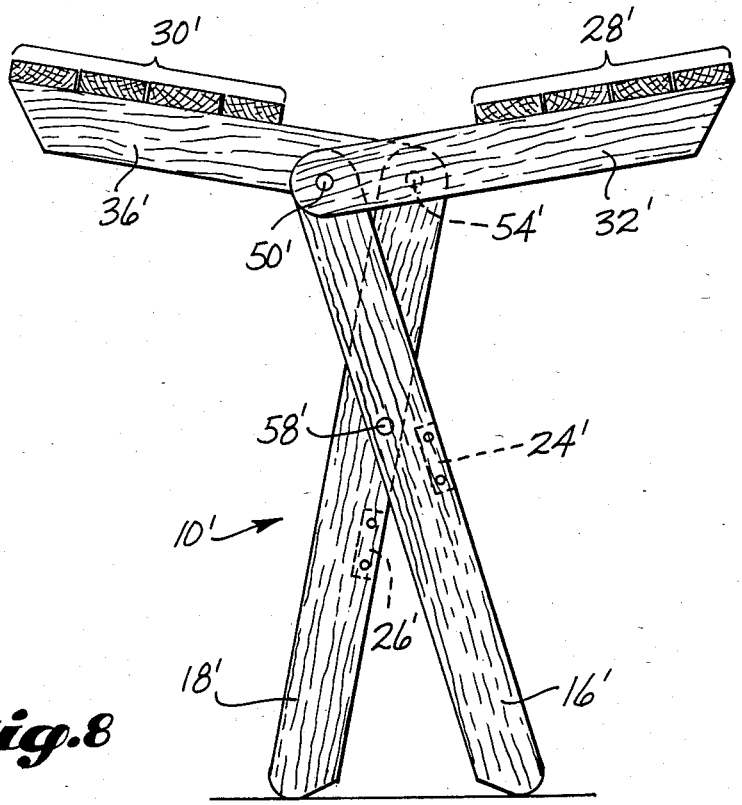
Fig. 8

FOLDING TABLE

DESCRIPTION

1. Technical Field

This invention relates to folding tables of a type having a pair of crossing leg members at each end of the table and two top parts pivotally connected to the upper ends of the leg members. More particularly, it relates to the provision of such a table having an arrangement of the leg members, which permits the placement of longitudinal brace members for the leg members, in out of the way positions.

2. Background Art

This invention relates to the general type of table disclosed by U.S. Pat. No. 2,587,010, granted Feb. 26, 1952, to Richard W. Thompson, and by U.S. Pat. No. 3,692,358, granted Sept. 19, 1972, to Albert Y. Sung. The table design disclosed by Thompson U.S. Pat. No. 2,587,010 requires an independent special handle for carrying the table in its folded position. Also, the under support members for the top parts of the table do not provide a support for the full under surface.

Sung U.S. Pat. No. 3,692,358 proposes to solve a problem of Thompson U.S. Pat. No. 2,587,010 by the provision of a longitudinal brace member 35 which doubles as a handle for the table when it is in its folded condition. A problem with the construction of the Sung table is that the lower longitudinal braces are positioned whereat they can interfere with the feet of the users of the table.

The principal object of the present invention is to provide a folding table which is sturdier in construction than the tables disclosed by Thompson U.S. Pat. No. 2,587,010 and Sung U.S. Pat. No. 3,692,358, and which include longitudinal brace members which adequately brace the table and which are positioned high enough to not interfere with the legs of the users.

Additional folding tables which exist in the patent literature are disclosed by the following U.S. patents: U.S. Pat. No. 1,890,710, granted Dec. 13, 1932, to Lewis S. Williams; No. 2,197,302, granted Apr. 16 1940, to Charles D. Goering; No. 2,618,525, granted Nov. 18, 1952, to William C. Panzer and No. 3,704,674, granted Dec. 5, 1972, to Charles J. Johnson.

These patents should be carefully considered together with Thompson U.S. Pat. No. 2,587,010 and Sung U.S. Pat. No. 3,692,358 when putting the present invention into proper perspective relative to the prior art.

DISCLOSURE OF THE INVENTION

In accordance with the present invention, in at least the region above the pivotal connection of the leg members, and a short distance below the pivotal connection, the lower edge of each leg member is offset inwardly of the upper edge of the other leg member when the leg members are folded together. This arrangement produces a space between the plane in which the upper edges of the outside members are situated and the plane in which the offset lower edge portions of the inside leg members are situated which is of a width to accommodate a longitudinal brace member. This longitudinal brace member is interconnected between the two outer leg members. It has an outer face which is substantially flush with the upper edges of the outer leg members. As previously mentioned, when the table is folded, this longitudinal brace member is positioned between the plane of the upper edges of the outside leg members and the plane of the offset lower edges of the inside leg members. When the table is open, this longitudinal brace member is positioned contiguous a contact position with lower edge portions of the inside leg members.

Additional objects, features and advantages of the invention are disclosed and discussed in the detailed description of the best mode, and are particularly pointed out and distinctly claimed in the claims which follow such description. The detailed description of the best mode and the claims constitute portions of the disclosure of the invention.

BRIEF DESCRIPTION OF THE DRAWINGS

Like reference numerals are used to designate like parts throughout the several views of the drawing, and:

FIG. 1 is a pictorial view of an embodiment of a folding table constructed according to the present invention, shown in an open or unfolded position;

FIG. 2 is a view like FIG. 1, but showing the table partially open;

FIGS. 7–9 are like FIGS. 4–6, but of a modified form of table having uniform width leg members.

BEST MODE FOR CARRYING OUT THE INVENTION

Figure 3:
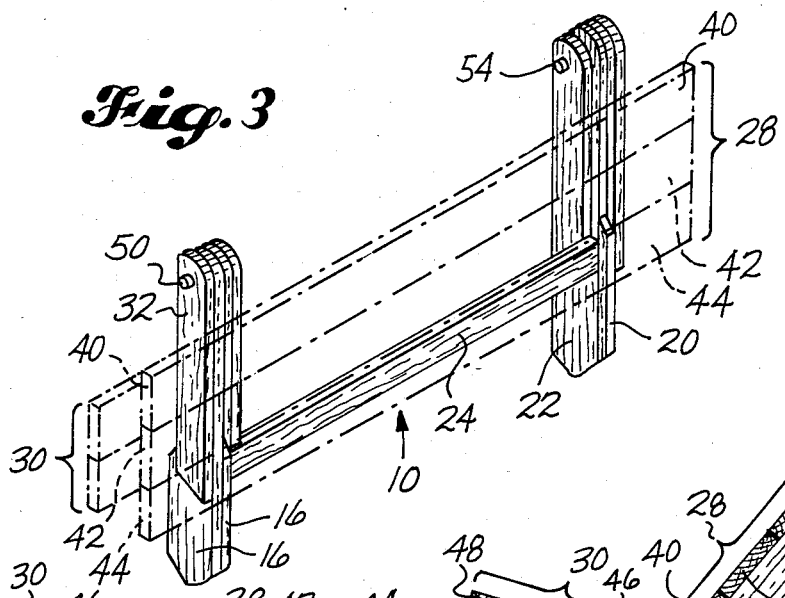
FIG. 3 is a view like FIGS. 1 and 2, but showing the table closed or folded.
Figure 4:
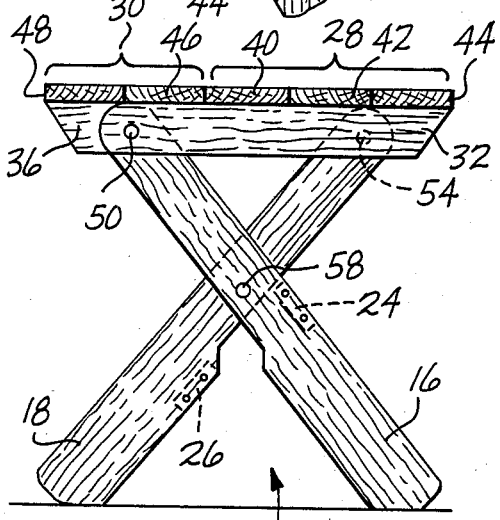
FIG. 4 is an end view of the table shown by FIGS. 1–3, in an open or unfolded condition.
Figure 5:
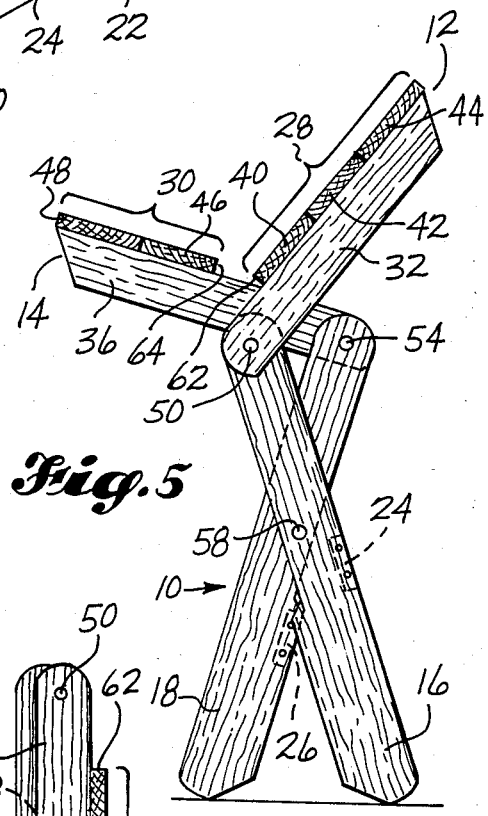
FIG. 5 is a view like FIG. 4, but showing the table partially open.

Referring to the drawing, the table 10 comprises two top parts 12, 14, four leg members 16, 18, 20, 22 and two longitudinal brace members 24, 26.

Each top part 12, 14 comprises top plank means 28, 30 and a pair of under support members 32, 34, 36, 38.

At each end of the table 10 there is an outside leg member and an inside leg member. At one end of the table the outside leg member is designated 16 and the inside leg member is designated 18. At the opposite end of the table 10, the outside leg member is designated 20 and the inside leg member is designated 22.

Top part 12 comprises a pair of outside under support members 32, 34. These members 32, 34 are termed "outside" members because they are situated on the outside of the outside leg members 16, 20. Top part 14 comprises a pair of inside under support members 36, 38. They are situated inside of the inside leg members 18, 22.

In the illustrated embodiment, the top plate means 28 for top part 12 comprises three plank members 40, 42, 44. Top plank means 30 for top part 14 comprises two plank members 46, 48.

Plank members may be used which are different in width than the illustrated plank members. For example, plank members may be used which are of such a width that the top plank means 28 is equal in width to the top plank means 30. Also, a single member of appropriate width could be used to form the top plank means 28, 30.

The under support members 32, 34 are each pivotally connected to the upper end of the outside leg member 16, 20 at its end of the table 10. In like fashion, the under support members 36, 38 are each pivotally connected to the upper end of the inside leg member 18, 20 at its end of the table 10.

In the embodiment shown by FIGS. 1–6, the leg members 16, 20 and 18, 22 have relatively wide lower portions and narrow upper portions. The upper portions are chosen to be of the same width as the material used for the under support members 32, 34, 36, 38. The pivotal connections 50, 52, 54, 56 are centered between the edges of the members, so that when the under support members 32, 34 are folded toward leg members 16, 20 and the under support members 36, 38 are folded towards leg members 18, 22, the under support members 32, 34 exactly side lap the upper portions of the leg members 16, 20 and the under support members 36, 38 exactly side lap the upper portions of the leg members 18, 22. The expression "exactly side lap" is used herein to mean that the members are side-by-side and their respective edges are even with each other.

The pivot means 58, 60 which pivotally connect together the two pairs of leg members 16, 18 and 20, 22 are laterally centered with respect to the lower wider portions of the leg members 16, 18. Thus, when the table is folded and the leg members 16, 18 are in a side lapping position and the leg members 20, 22 are in a side lapping position, the respective lower edges of the pairs of leg members 16, 18 and 20, 22 are even (see FIG. 6). However, the edges of the upper portions of the leg members 16, 18 and 20, 22 are not even.

Herein the edges of the leg members 16, 20 and 18, 22 which are downwardly directed when the table is open (FIGS. 1 and 4) are termed the lower edges of the leg members. The edges which are upwardly directed are termed the upper edges of the leg members 16, 20 and 18, 22.

When the embodiment shown by FIGS. 1–6 is folded, the lower edges of the upper portions of outside leg members 16, 20 are offset inwardly from the upper edges of the inside leg members 18, 20. In similar fashion, the upper edges of the outside leg members 16, 20 are offset outwardly from the lower edges of the upper portions of the inside leg members 18, 22.

This arrangement makes it possible to use longitudinal brace members 24, 26. The brace member 24 is interconnected between portions of the outside leg members 16, 20 which are located below and to the upper edge side of the pivot pins 58, 60. Brace member 26 is interconnected between the inside leg members 18, 22. The outside face of member 24 is flush with the upper edges of leg members 16, 20. The inside face of member 26 is flush with the lower edges of the lower portions of inside leg members 18, 22.

When the table 10 is folded (FIGS. 3 and 6) the brace member 24 is brought into contact or near contact with lower edge portions of inside leg members 18, 22, in a region below the pivot pins 58, 60. Member 24 is substantially equal in width to the difference in width between the upper and lower portions of the leg members 16, 20 and 18, 22, i.e. substantially equal in width to the offset.

When the table 10 is folded, the inside face of member 24 is against or substantially against the lower edge of the reduced width upper portions of the inside leg members 18, 22. The brace member 26 is positioned substantially vertically below member 24, in coplanar parallelism with member 24. The lower wider portions of leg members 16, 20 side lap the lower wider portions of leg members 18, 22, with their edges substantially even, i.e. they exactly side lap each other. The top plank means 28 is positioned immediately outwardly of the upper edges of leg members 16, 20 and a portion of top plank means 28 is outwardly contiguous the brace members 24, 26. The top plank means 30 is immediately outwardly of the upper edges of the inside leg members 18, 22. The under support members 32, 34 are in an edge matching side lapping relationship with the upper reduced width portions of the outside leg members 16, 20. The under support members 36, 38 are in an edge matching side lapping relationship with the narrower upper portions of the inside leg members 18, 22. The inside surfaces of the top plank means 28, 30 occupy parallel planes which are spaced apart the width of the lower portions of the leg members 16, 20 and 18, 22.

The top plank means 28, 30 each includes an inner edge 62, 64.

The table 10 is moved from its folded position to its unfolded or open position by swinging the top parts 12, 14 in position, about the pivotal axes 50, 52 and 54, 56, to bring the edges 62, 64 together. At the same time, the two pairs of leg members 16, 18 and 20, 22, are moved apart like the opening of a pair of scissors, and the top parts 12, 14 are manipulated so as to place the top plank means 28, 30 in substantially horizontal positions, with the edges 62, 64 together. The leg members 16, 18 and 20, 18 can open until contact is made between the edges 62, 64.

Thus, contact of the edges 62, 64 serves as a stop and in this manner determines the open position of the table.

Figure 6:
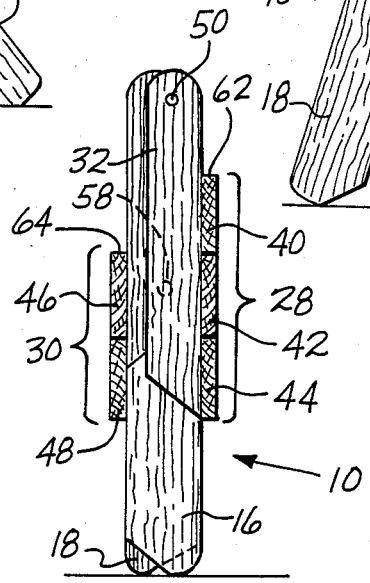
FIG. 6 is a view like FIGS. 4 and 5, but showing the table closed or folded.

As clearly shown by FIGS. 3 and 6, when the table 10 is closed, it forms a very compact package. This construction of the table 10, makes it possible to construct the table from good quality wood members and still use the table 10 outdoors without a fast deterioration of the materials. The table 10 can be easily carried outdoors in a folded condition, and then opened up and used. During bad weather, or during periods in which there is no desire to use the table, it can be folded up and moved indoors out of the weather.

FIG. 7 discloses a modified construction of the table. This table is like the table described above in connection with FIGS. 1–6 except that the narrow width of the leg members is continued downwardly throughout the full length of the table legs. As clearly shown by FIG. 7, when the narrower materials are used, the entire upper edges of the outside leg members 16', 20' are spaced outwardly from the entire lower edges of the inside leg members 18', 22'. The upper edges of the inside leg members 18', 22' are spaced outwardly of the full lower edge of the outside leg members 16', 22'. As in the embodiment shown by FIGS. 1–6, the amount of edge offset is equal to the width of the transverse brace members 24, 26.

The above description is presented for example rather than limitation. I am to be limited solely by the claims which follow and by the rules of patent claim interpretation, including the doctrine of equivalents.

What is claimed is:

1. In a folding table of a type having a pair of leg members at each end of the table pivotally connected together at their midportions, for movement between a crossing open position and an in-parallelism, side lapping closed position, and a pair of top parts pivotally connected to the upper ends of the leg members and movable between positions parallel to and outside of the leg members when the table is folded and coplanar positions above the leg members when the table is open, in which they abut each other and lock the leg members in the open position, the improvement of:

said table having an outside leg member and an inside leg member at each end of the table, and wherein such leg members are pivotally connected together such that when the table is folded the lower edge of each leg member is offset inwardly from the upper edge of the other leg member in the region above the pivotal axis and in at least a portion of the region below the pivotal axis; and said table including a longitudinal brace member interconnected between the two outside leg members at a location below the pivotal axis and at the upper edges of the outside leg members, said longitudinal brace member having inner and outer sides and being positioned such that when the leg members are crossing and the table is open, the brace member is contiguous the inside leg members, and said longitudinal brace member is further positioned such that it lies in a space between the upper edges of the outside leg members and the lower edges of the inside leg members when the table is folded, with its outer side substantially flush with the upper edges of the outside leg members and its inner side substantially contacting the lower edges of the inside leg members, and wherein there is open space between the outside leg members, below the longitudinal brace member, to provide leg space when the table is open.

2. A folding table according to claim 1, wherein each top part of the table includes a pair of under support members which are equal in width to at least the upper portions of the leg members, and when the table is folded the under support members side lap the upper portions of the leg members, with their edges even with the edges of the leg members.

3. A folding table according to claim 1, wherein each top part comprises a plurality of side-by-side placed top plank members.

4. A folding table according to claim 1, further comprising a second longitudinal brace member interconnected between the two inside leg members at a location below the means which pivotally connects the midportions of the outside leg members to the midportions of the inside leg members.

5. A folding table according to claim 1, wherein each leg member comprises a lower portion which is wider than its upper portion and the extra width is at the lower edge of each leg member.

6. A folding table according to claim 5, wherein when the table is folded the lower edge of the lower portion of each outside leg member is substantially flush with the upper edge of each lower portion of the inside leg member, and the upper edge of the lower portion of each outside leg member is substantially flush with the lower edge of the lower portion of each inside leg member.

* * * * *